United States Patent [19]

Shaw et al.

[11] 4,140,385

[45] Feb. 20, 1979

[54] LOW PRESSURE METAL OR METAL HALIDE LAMPS FOR PHOTOCOPYING APPLICATIONS

[75] Inventors: James F. Shaw, Arcadia; Kenneth L. Luttio, Azusa, both of Calif.

[73] Assignee: Xerox Corporation, Stamford, Conn.

[21] Appl. No.: 668,875

[22] Filed: Mar. 22, 1976

[51] Int. Cl.[2] ..... G03G 15/00

[52] U.S. Cl. ..... 355/3 R; 355/67; 313/15

[58] Field of Search ..... 355/70, 67, 3 R, 11; 313/15; 315/46, 49

[56] References Cited

U.S. PATENT DOCUMENTS

| | | | |
|---|---|---|---|
| 3,194,965 | 7/1965 | Ruff et al. | 313/112 X |
| 3,400,288 | 9/1968 | Groth | 313/47 |
| 3,914,649 | 10/1975 | Hug | 355/69 X |
| 3,961,222 | 6/1976 | Gallo | 315/49 |
| 4,004,171 | 1/1977 | Heuvelmans et al. | 313/15 |

*Primary Examiner*—William M. Shoop

[57] ABSTRACT

A low pressure metal or metal halide vapor lamp for photocopying applications. In a preferred embodiment, the metal vapor comprises sodium. The low pressure sodium vapor lamp, having a preferred lamp aperture geometry, is operated in a continuous mode and provides illumination of increased brightness and of a color (yellow) which is optimum for providing a copy which is an accurate representation of the original. In order to decrease the warmup time of the lamp and achieve operating temperatures relatively quickly, an auxiliary heater is formed on the lamp. A two pin end cap may be used for electrical connections, one pin carrying filament power and the other carrying auxiliary heater power.

2 Claims, 3 Drawing Figures

LOW PRESSURE METAL OR METAL HALIDE LAMPS FOR PHOTOCOPYING APPLICATIONS

BACKGROUND OF THE INVENTION

In the xerographic process as described in U.S. Pat. No. 2,297,691, a base plate of relatively low electrical resistance such as metal, etc., having a photoconductive insulating surface coated thereon is electrostatically charged in the dark. The charged coating is then exposed to a light image. The charges leak off rapidly in the base plate in proportion to the intensity of light to which any given area is exposed, the charge being substantially retained in non-exposed areas. After exposure, the coating is contacted with electrostatic materials which adhere to the remaining charges to form a powder image corresponding to the latent electrostatic image remaining after exposure. The powder image then can be transferred to a sheet of transfer material resulting in a positive or negative print, as the case may be. Since dissipation of the surface electrostatic charge is proportional to the intensity of the impinging radiation, light sources of uniform and sufficient intensity must be provided so that the photoconductive insulator can be properly exposed.

Low pressure metal or metal halide lamps are a near optimum illumination source for photocopiers producing black and white output copies from black and white and multi-colored originals.

With respect to line copy, the optimum goal of any black and white photocopying apparatus is to make the image areas on the copy as black as possible. In other words, one would like a minimum of energy reflected from the image areas of the original while reflecting a maximum from the background region. Obviously, it is impossible to copy all colored backgrounds as white while concurrently copying all colored images as black.

From prior experience, it appears that most colors that are utilized as images on an original tend to be located at the extremes of the visible spectrum, i.e., blues and reds, whereas yellow, for example, is seldom utilized for images. Colored backgrounds are pastel (desaturated) and can usually be considered as tinted white paper which may be explained in part on well known principles of physiological optics (photoptic vision).

It then follows that the optimum light source for photocopying apparatus producing black and white output copies from black and white and multi-colored originals produces yellow light whereby black and reds will copy as black, while concurrently most common colored papers have considerable reflectance in yellow (it should be noted that the use of the yellow exposure lamps obviously necessitates a yellow sensitive photoreceptor). However, the typical prior art photocopying apparatus utilizes aperture fluorescent lamps which generate colored light.

Low pressure sodium lamps represent a commercially available yellow light source. Present commercial sodium lamps, such as those manufactured by N. V. Phillips, have several disadvantages for photocopying applications associated therewith.

The principal problem is that a long warm-up period is required before the lamp may be operated at its optimum efficiency, i.e., at an operating temperature of approximately 260° C. which in turn corresponds to a vapor pressure of approximately 0.005 Torr. For example, whereas unassisted fluorescent lamps require only a matter of seconds to reach peak radiance, unassisted sodium lamps require several minutes to heat the lamp and achieve the optimum vapor pressure for radiation output. The prior art has sought to reduce long warmup times in sodium lamps by maintaining the lamp continuously energized. However, additional problems arise if the sodium lamp is on continuously. For example, the photoreceptor may fatigue when it is continuously flooded with light produced by said sodium lamp, the heat generated by the sodium lamp may harm the photoreceptor, and continuous operation of the lamp may add to the cost of a customer's electrical bill. Further, most commercially available low pressure sodium lamps are in a U-tube configuration which causes a fit problem in most photocopying apparatus because of its large diameter, the U-shaped lamp also emitting light in all directions which is inefficient and unacceptable for photocopying use.

U.S. Pat. No. 3,914,649, issued Oct. 21, 1975, discloses a low pressure sodium vapor lamp for use in photocopying apparatus operated in a pulsed mode. Although advantages are attained in using such a lamp in a pulsed mode, it is desirable in many applications that a low pressure sodium vapor lamp of high efficiency and short warmup periods be provided without the additional components required for pulsed operation.

SUMMARY OF THE PRESENT INVENTION

The present invention provides a low pressure metal or metal halide vapor lamp for use in photocopying apparatus. In the preferred embodiment, the active material comprises sodium. The low pressure sodium vapor lamp, having a preferred lamp aperture geometry provides illumination of increased brightness and of a color (yellow) which is optimum for providing a copy which is an accurate representation of the original. In order to decrease the warmup time of the lamp and achieve operating temperatures relatively quickly, an auxiliary heater is formed on the lamp. A two pin end cap may be used for electrical connections, one pin carrying lamp power and the other carrying auxiliary heater power. The use of low pressure sodium vapor lamps enables copies to be made of most originals, the copies being an accurate representation of the original.

It is an object of the present invention to provide apparatus for utilization in a photocopying apparatus wherein a low pressure metal or metal halide lamp is utilized as the illumination source.

It is a further object of the present invention to provide apparatus for utilization in photocopying apparatus wherein a low pressure sodium vapor lamp is utilized as the illumination source, the lamp having a preferred lamp aperture geometry and means associated with the lamp to decrease the warmup time of the lamp.

It is still a further object of the present invention to provide apparatus for providing a low pressure sodium vapor lamp which provides a spectral output which is particularly useful in photocopying applications, the lamp having a lamp aperture geometry which increases lamp efficiency and heating means for decreasing lamp warmup times.

It is a further object of the present invention to provide a low pressure sodium vapor lamp for use in photocopying applications, the lamp including multi-pin end caps for electrical connections to the lamp.

BRIEF DESCRIPTION OF THE DRAWINGS

For a better understanding of the present invention, as well as other objects and further features thereof, reference is made to the following description which is to be read in conjunction with the accompanying drawings wherein.

DESCRIPTION OF THE PREFERRED EMBODIMENT

Figure 1:
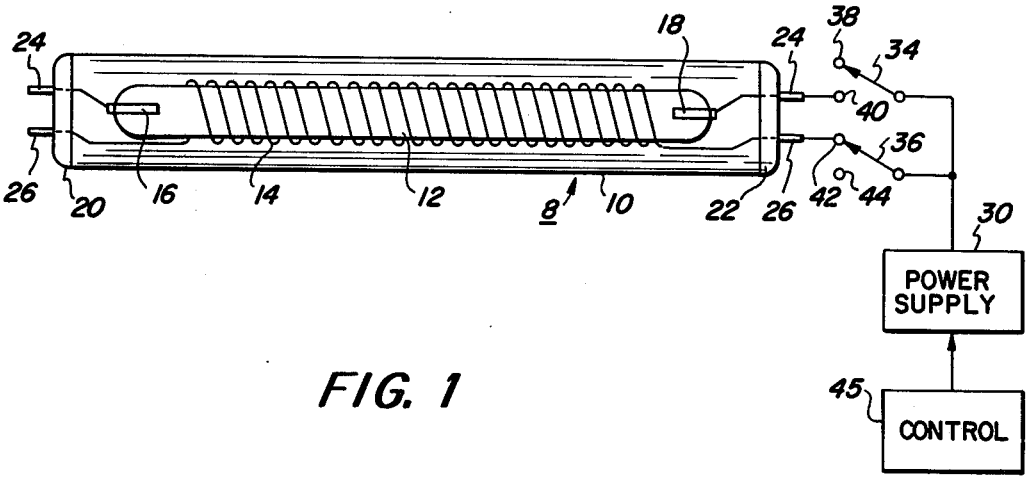
FIG. 1 shows a low pressure sodium vapor lamp in accordance with the teachings of the present invention.

FIG. 1 is a partial cross-sectional view of the low pressure sodium vapor lamp 8 of the present invention. The lamp 8 comprises an outer envelope 10, a linear, inner envelope or discharge tube 12, heater wire 14, electrodes, or filaments 16 and 18 and tube sealing end caps 20 and 22, each end cap incorporating end pins 24 and 26. End pins 24 and 26 in end cap 22, when lamp 8 is mounted to the appropriate lamp utilization means such as photocopying apparatus, are coupled to a controllable source of alternating current 30 via double pole, single throw switch 32 having mechanically coupled contact arms 34 and 36, contact arm 34 having contacts 38 and 40 associated therewith and contact arm 36 having contacts 42 and 44 associated therewith. Whem lamp 8 is to be energized, contact arms 34 and 36 are caused to be moved by a delay coil (not shown) whereby contact arm 34 is positioned at contact 40 and contact arm 36 is positioned at contact 44 whereby filament 18 is connected to power supply 30. In the standby mode (lamp 8 not energized) end pin 26 (and therefore heater wire 14) is coupled to controllable power supply 30 via contact arm 36 and contact 42. As is disclosed in the copending application Ser. No. 669,079 by H. Hill, power supply 30 supplies a variable current to heater wire 14 in response to a voltage signal supplied by controller 45, the current in wire 14 being controlled in a manner whereby the lamp vapor temperature is maintained at a value which is optimum for lamp efficiency and reduced lamp warmup times.

As set forth hereinabove, in order to decrease lamp warmup time and achieve operating temperature rapidly, auxiliary resistance heater 14 is used, the resistance heater also being used to maintain the inner tube at its normal operating temperature (approximately 260° C.). However, the heater can be used to maintain the temperature at any desired value. The preferred embodiment of the resistance heater consists of a spiral wrapped wire around the linear sodium tube 12 with the spacing of the wraps being dependent on the length of wire required. For efficient operation, there are two requirements for the heater wire. First it should be oxidation-resistant and secondly, should show an appreciable variation in resistivity with temperature. This allows the temperature changes in the lamp being heated to be sensed for control purposes as described in the aforementioned copending application. The present configuration uses 0.010 inch alumel wire. This nickel-iron alloy resists oxygen attack and changes resistance considerably with temperature. The preferred construction is wire or strip, but is not limited to the stated shape as long as its functional characteristic is fulfilled. Other techniques may be utilized to heat the inner envelope 12 such as applying a transparent conductive coating to the lamp envelope or by utilizing a heating resistance within the inner lamp envelope, as shown in U.S. Pat. No. 2,755,400. The auxiliary heater 14 consumes less power than an operating lamp and since there is no visible radiation from the tube 12 during preheat and while on standby (i.e. contact arm 34 positioned at contact 38 and contact arm 36 simultaneously positioned at contact 42) there is no photoreceptor fatigue which can occur if a lamp is running continuously (i.e., radiation is emitted continuously).

The present preferred warmup cycle uses a high current (i.e. 3.0 amps) from source 30 initially for start-up and as the heater resistance 14 increases to its normal operating point, power supply 30 switches to a lower current (approximately 2.1 amps) to hold this resistance constant. When the arc is ignited (contact arm 34 positioned at contact 40 and contact arm 36 positioned at contact 44) heater power is turned off and when the arc is extinguished, the heater power is turned on. The details of the circuit for controlling the application of current to either the heater wire or the lamp filaments is disclosed in the aforementioned copending application, the teachings thereof which are necessary for the understanding of the present invention being incorporated by reference. By maintaining the lamp at a standby temperature of approximately 260° C., full radiant output is achieved in approximately 5 seconds when the arc is switched on in contradistinction to the 60 seconds required for the lamp to warmup to the optimum temperature from ambient conditions.

Figure 2:
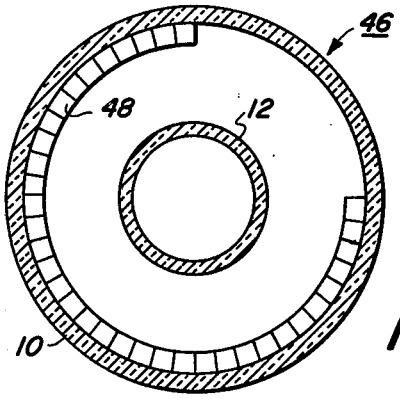
FIG. 2 is a cross-sectional view of the low pressure sodium vapor lamp of FIG. 2 showing the preferred aperture lamp geometry.

FIG. 2 shows the aperture 46 that is used with the preferred sodium vapor lamp embodiment. The typical fluorescent lamp uses the aperture to direct emitted photons on the target. As the fluorescent phosphors are excited, the photons are reflected around the tube until they exit through the aperture. In the case of sodium lamps, it is not possible to use many reflections to reach the exit, since the arc discharge tube 12 is optically dense and absorbs an appreciable fraction of this radiation in a specular system. For this reason, a diffuse coating 48 is selected to coat the aperture tube since it has a higher reflectivity than the specular system and because only about one-half of the reflected photons go towards arc discharge tube 12. The diffuse reflector 48 is more efficient than a specular reflector of the same dimensions, concentrates the lamp output and reduces the concentricity requirements of tubes 10 and 12. The preferred diffuse coating is one which exhibits a diffuse reflectivity of 90 percent or better. Typical coatings which have been shown to meet these requirements include Zynolyte White 0645 high temperature primer, available from the Zynolyte Products Company, Compton, Calif. and Eastman paint #6080, available from Eastman Kodak Company, Rochester, N.Y. A typical coating thickness is either spray or dip deposited to a thickness of 0.01 inch, the coating extending to an angle of 270 degrees (clear aperture of 90 degrees).

FIG. 1 illustrates a design which may be utilized in photocopying apparatus. The linear arc tube 12 is placed within a 1.5 inch diameter transparent tube 10 which is coated with diffuse coating 48. Commercially available two pin end caps 20 and 22, typically used on fluorescent lamps, are used for electrical connections. In particular, pin 24 heats the filament and pin 26 carries auxiliary heater power. An alternate configuration that can be used comprises a three pin end cap with one pin carrying auxiliary heater power, one pin heating the filament and the remaining pin supplying arc power.

Typically the filaments 16 and 18 are spaced from each other within an insulating tube, or container 12 which is filled with an alkali metal and gas mixture. The choice of the fill gas, its fill pressure, and the electrode filament separation distance depend on desired radiation characteristics, and also its electrical characteristics in relationship with the power supply. The insulating wall container 12 may be made of quartz, glass, quartz/glass combination (any of which can be coated or manufactured for resistance to attack by alkali metals), or ceramic material. The fill gas may be xenon, krypton, neon, or argon or any combination of inert gases, whereas the alkali metal may include the whole series and combinations thereof. The preferred combination of fill gas and alkali metal is sodium alkali metal at an operating pressure of 0.005 Torr with a gas mixture fill at a pressure of about 5 Torr of neon and 1 percent argon, the argon pressure being about 0.05 Torr.

In the standby mode of operation (prior to initiation of a discharge through the gaseous medium) switch 32 is positioned as shown in FIG. 1. When the photocopying apparatus is ready for copying (operating mode) a signal from the apparatus causes contact arm 34 to be positioned at contact 40 simultaneously with the positioning of contact arm 36 at contact 44. In this mode, the current from source 30 is sufficient to effect a discharge through the gaseous medium within the envelope 12 between the filaments 16 and 18. This initial voltage required to operate the lamp is referred to as the breakdown voltage and is usually greater than later lamp operating voltages because of increased ionization and electrial conductivity of the gaseous medium within envelope 10 after the lamp has been operated for a time.

Lamp 8, in accordance with the teachings of the present invention, is a metal or metal halide vapor lamp, and in the preferred embodiment, comprises a low pressure sodium vapor lamp. When the gas is ionized, as described hereinabove, an actinic light is generated. Since low pressure sodium is utilized, the spectral output is predominantly in the 5900Å range and corresponds to yellow light.

The heating current supplied by power supply 30 heats winding 14 to maintain the inner envelope 12 at an elevated temperature (i.e., approximately 260° C.) which causes the vapor pressure of the sodium (approximately 0.005 Torr) to be correspondingly optimized for optimum sodium line output, i.e., spectral output is primarily centered about 5900Å and to decrease the warmup time of the lamp whereby the lamp operating temperature is achieved relatively quickly as set forth hereinabove.

In addition to the sodium vapor lamp described hereinabove, other materials, such as thalium, thalium iodide and potassium, may be utilized as the gaseous medium albeit sodium is preferred for the reasons set forth hereinabove.

Figure 3:
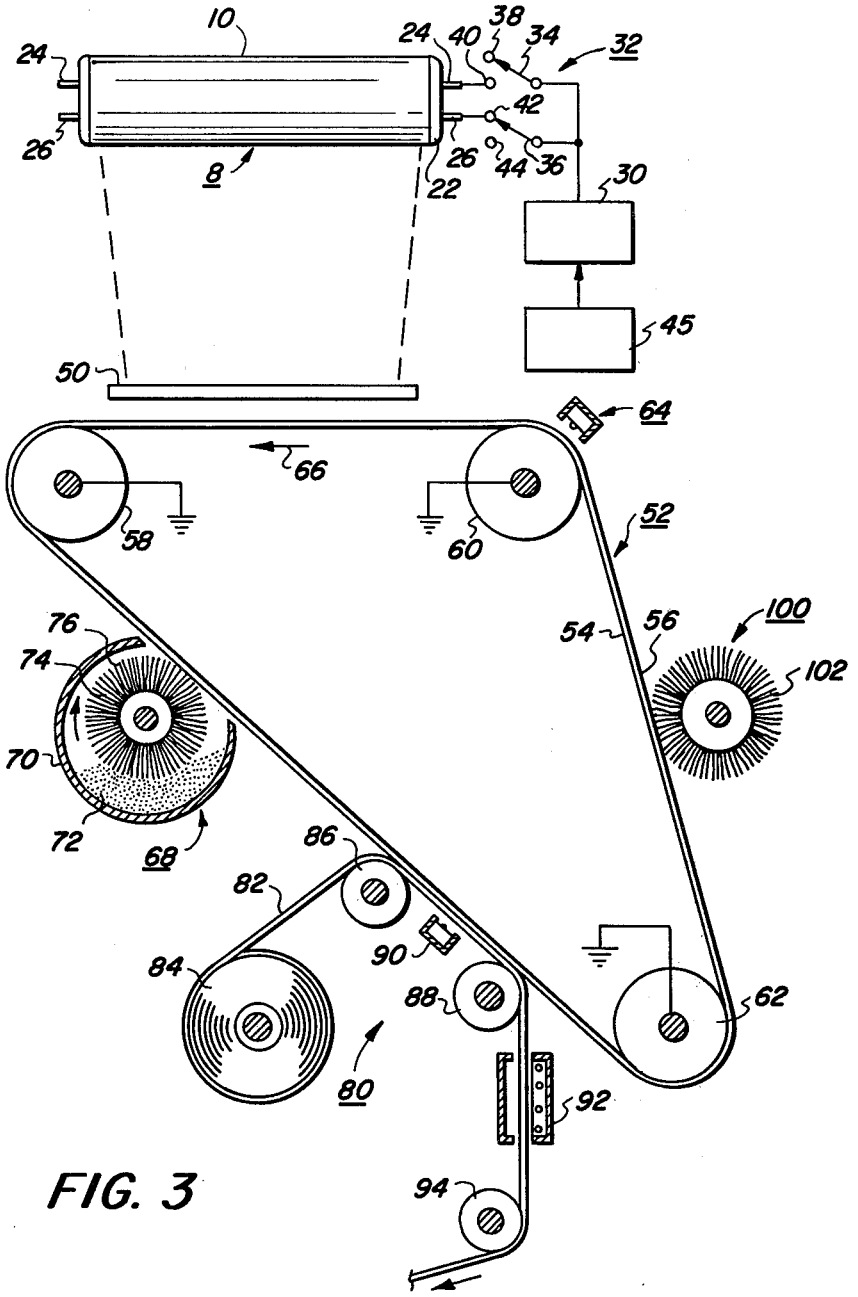
FIG. 3 illustrates an electrostatic photocopying apparatus in which the present invention may be utilized.

FIG. 3 schematically illustrates apparatus for electrostatically photocopying documents, or originals, using the xerographic process and the subject matter of the present invention. The sodium vapor lamp apparatus described in FIG. 1 is positioned above original 50 from which copies are to be made. In the embodiment illustrated, endless belt 52 having a conductive base 54 and a coating 56 of photoconductive material, which is selected to be rendered conductive by the illumination generated by lamp 8 is arranged to run on spaced drums 58, 60, and 62 underneath document 50. Although not shown in the figure, drums 58, 60 and 62 are driven in tandem by an appropriate drive motor.

In operation, the photoconductive belt 52 which essentially comprises a layer made of selenium on an alloy thereof overlying a conductive substrate is initially charged at charging station 64. The charging station comprises a generally well known corona charging device as shown in the prior xerographic art, for example. The belt 52, shown in an endless belt configuration, is driven in the direction of arrow 66. When the lamp 8 is energized in the manner described hereinabove (i.e., when a copy is to be made), the illumination generated thereby (the sodium spectral line in the preferred embodiment) illuminates document 50. It should be noted that the apparatus of FIG. 3 assumes that the original 50 is a transparency since the illumination will pass therethrough to expose photoconductive layer 56. Obviously, illumination lamp 8 can be positioned below original 50 if the original is opaque, the generated light being reflected therefrom. In any event, the portions of the document 50 corresponding to image areas or dark areas are absorbed and the background or transparent areas illumination are passed through to discharge the appropriate portions of the belt 56. The belt is advanced to a development station 68 whereat a housing 70 contains a charge of electroscopic toner particles 72 and a roll 74 having a brush 76 on its surface. As roll 74 rotates, the brush 76 passes through the toner particles and then across the surface of belt 52, distributing the toner particles over the surface of the belt. The toner particles adhere to the belt in areas containing a residual charge, but not in the uncharged areas, resulting in development to visual form of the latent electrostatic image corresponding to document 50. Alternate development techniques may be utilized, such as powder cloud development as described, for example, in U.S. Pat. No. 2,701,764.

At station 80, this image is transferred to image receiving web 82. Web 82 is drawn from supply roll 84 and is guided in contact with belt 52 for a short distance by guide rolls 86 and 88. Transfer of the toner particles constituting the development image may be aided by an appropriate electrical field or by charging of the web 82 by corona charging electrode 90, as is well understood in the art. After the image is transferred to the web 82, the web may be passed through a heater 92 to fuse the toner particles to the web, and the web is guided by roll 94 to a delivery station.

Since the photoconductive layer 56 is to be reused for a subsequent imaging cycle, after the image transfer operation residual toner particles are removed from the surface of belt 52 by brush 102 at station 100. The photoconductive layer 56 may then be exposed to an illumination source, to erase any residual electrostatic image. Before returning to the optical exposure station, the surface of the photoconductor is exposed to a general corona discharge at station 64, to provide a uniform electrostatic charge over the photoconductive layer 56 and thereby enable electrostatic optical recording of an image of the document 50.

If a multiple number of copies of original 50 are to be made, the same operation is repeated. If a copy of a different original is desired, the original 50 is replaced with the different original.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. In apparatus in which a radiation pattern is projected from an information bearing member illuminated by a visible light source onto a charged photoconductive insulating member to imagewise discharge said photoconductive member to form a latent electrostatic charge pattern corresponding to said information bearing member, an improved low pressure metal vapor lamp having a short warmup time which when ignited emits visible light having a radiation intensity level sufficient to expose said photoconductive member and which when operated in a standby mode has a standby temperature which permits such short warmup time and provides increased lamp efficiency, said improved lamp comprising:

an outer envelope having a substantially transparent annular cross section and being coated with a diffusely reflecting material about a portion of the periphery thereof, said diffusely reflecting material being reflective of visible illumination, said diffusely reflecting material extending in a logitudinal direction to form a longitudinally extending aperture of a predetermined geometry along said envelope for directing said visible illumination onto said information bearing member.

an inner envelope within said outer envelope in spaced, substantially coaxial relationship therewith and containing a combinational quantity of low pressure sodium vapor and gas fill mixture, said inner envelope including electrode means adapted when energized for initiating an ionization discharge of said gas within said inner envelope, resistance heating means operatively associated with said inner envelope and adapted when energized to heat said inner envelope and thereby heat said sodium vapor and gas fill mixture therewithin to said predetermined standby temperature, said resistance heating means comprising an oxidation resistant material having an increasing resistivity relative to temperature, heating control means operatively connected to said resistance heating means through said outer envelope for selectively energizing said heating means and maintaining said inner envelope at said predetermined standby temperature, and lamp control means operatively connected to said inner envelope electrode means through said outer envelope for selectively energizing said inner envelope electrode means and initiating said ionization discharge of said gas within said envelope and illuminating said information bearing member.

2. The apparatus as defined in claim 1 wherein said gas fill mixture comprises neon and argon.

* * * * *